US008183779B2

(12) United States Patent
Oda et al.

(10) Patent No.: US 8,183,779 B2
(45) Date of Patent: May 22, 2012

(54) ESCIMER LAMP HAVING DISCHARGE GAP CONTROLLED BY FLUORINE CONCENTRATION

(75) Inventors: Fumihiko Oda, Hyogo (JP); Kengo Moriyasu, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 28 days.

(21) Appl. No.: 12/926,020

(22) Filed: Oct. 21, 2010

(65) Prior Publication Data

US 2011/0109225 A1 May 12, 2011

(30) Foreign Application Priority Data

Nov. 6, 2009 (JP) ..... 2009-254483

(51) Int. Cl.
*H01J 11/00* (2012.01)
*H01J 65/00* (2006.01)

(52) U.S. Cl. ..... 313/607; 313/634; 445/22

(58) Field of Classification Search ..... 313/607, 313/623–627, 634
See application file for complete search history.

(56) References Cited

U.S. PATENT DOCUMENTS 6,379,024 B1 * 4/2002 Kogure et al. ..... 362/263
7,187,138 B2 * 3/2007 Kogure ..... 315/248
2009/0058299 A1 3/2009 Oda et al.

FOREIGN PATENT DOCUMENTS

JP 2009-59606 A 3/2009

* cited by examiner

*Primary Examiner* — Tracie Y Green
(74) *Attorney, Agent, or Firm* — Rader, Fishman & Grauer PLLC

(57) ABSTRACT

In an excimer lamp, rare gas and fluorine are enclosed inside a translucent ceramics arc tube. External electrodes are formed on an outer surface of the arc tube. A condition of $2.5+0.5\log(C_F) \leqq G \leqq 14-4\log(C_F)$ is satisfied in the case of $0.1 \leqq C_F \leqq 10$, wherein G (mm) is a discharge gap in the arc tube and $C_F$ (%) is molar concentration of the fluorine.

3 Claims, 6 Drawing Sheets

FIG.4

Table 1 Experimental result of G and illuminance/illuminance stability in case of $F_2$ concentration $C_F$=0.1%

| | $C_F$ [%] | $G$ [mm] | Illuminance [mW/cm²] | Illuminance Stability [%] | Overall Judgment |
|---|---|---|---|---|---|
| 1 | 0.1 | 1 | 0.2 | ○ | × |
| 2 | 0.1 | 1.5 | 0.8 | ○ | × |
| 3 | 0.1 | 2 | 10 | ○ | ○ |
| 4 | 0.1 | 2.5 | 11 | ○ | ○ |
| 5 | 0.1 | 3 | 11 | ○ | ○ |
| 6 | 0.1 | 6 | 12 | ○ | ○ |
| 7 | 0.1 | 10 | 12 | ○ | ○ |
| 8 | 0.1 | 14 | 12 | ○ | ○ |
| 9 | 0.1 | 17 | 13 | ○ | ○ |
| 10 | 0.1 | 18 | 13 | ○ | ○ |
| 11 | 0.1 | 19 | 13 | × | × |
| 12 | 0.1 | 20 | 13 | × | × |

Table 2 Experimental result of G and illuminance/illuminance stability in case of $F_2$ concentration $C_F$=0.5%

| | $C_F$ [%] | $G$ [mm] | Illuminance [mW/cm²] | Illuminance Stability [%] | Overall Judgment |
|---|---|---|---|---|---|
| 1 | 0.5 | 2 | 0.2 | ○ | × |
| 2 | 0.5 | 2.3 | 0.8 | ○ | × |
| 3 | 0.5 | 2.4 | 10 | ○ | ○ |
| 4 | 0.5 | 2.5 | 11 | ○ | ○ |
| 5 | 0.5 | 3 | 11 | ○ | ○ |
| 6 | 0.5 | 6 | 12 | ○ | ○ |
| 7 | 0.5 | 10 | 12 | ○ | ○ |
| 8 | 0.5 | 14 | 12 | ○ | ○ |
| 9 | 0.5 | 17 | 13 | ○ | ○ |
| 10 | 0.5 | 15 | 13 | ○ | ○ |
| 11 | 0.5 | 16 | 13 | × | × |
| 12 | 0.5 | 20 | 13 | × | × |

FIG.5

FIG.6

Table 3 Experimental result of G and illuminance/illuminance stability in case of $F_2$ concentration $C_F$=1.0%

| | $C_F$ [%] | $G$ [mm] | Illuminance [mW/cm$^2$] | Illuminance Stability [%] | Overall Judgment |
|---|---|---|---|---|---|
| 1 | 1.0 | 2 | 0.2 | ○ | × |
| 2 | 1.0 | 2.4 | 0.8 | ○ | × |
| 3 | 1.0 | 2.5 | 10 | ○ | ○ |
| 4 | 1.0 | 2.8 | 11 | ○ | ○ |
| 5 | 1.0 | 3 | 11 | ○ | ○ |
| 6 | 1.0 | 6 | 12 | ○ | ○ |
| 7 | 1.0 | 11 | 12 | ○ | ○ |
| 8 | 1.0 | 12 | 12 | ○ | ○ |
| 9 | 1.0 | 13 | 13 | ○ | ○ |
| 10 | 1.0 | 14 | 13 | ○ | ○ |
| 11 | 1.0 | 15 | 13 | × | × |
| 12 | 1.0 | 16 | 13 | × | × |

Table 4 Experimental result of G and illuminance/illuminance stability in case of $F_2$ concentration $C_F$=2.0%

| | $C_F$ [%] | $G$ [mm] | Illuminance [mW/cm ] | Illuminance Stability [%] | Overall Judgment |
|---|---|---|---|---|---|
| 1 | 2.0 | 2 | 0.2 | ○ | × |
| 2 | 2.0 | 2.6 | 0.8 | ○ | × |
| 3 | 2.0 | 2.7 | 10 | ○ | ○ |
| 4 | 2.0 | 2.8 | 11 | ○ | ○ |
| 5 | 2.0 | 3 | 11 | ○ | ○ |
| 6 | 2.0 | 6 | 12 | ○ | ○ |
| 7 | 2.0 | 10 | 12 | ○ | ○ |
| 8 | 2.0 | 11 | 12 | ○ | ○ |
| 9 | 2.0 | 12 | 13 | ○ | ○ |
| 10 | 2.0 | 12.5 | 13 | ○ | ○ |
| 11 | 2.0 | 13 | 13 | × | × |
| 12 | 2.0 | 14 | 13 | × | × |

FIG.7

FIG.8

Table 5 Experimental result of G and illuminance/illuminance stability in case of $F_2$ concentration $C_F$=5.0%

| | $C_F$ [%] | $G$ [mm] | Illuminance [mW/cm$^2$] | Illuminance Stability [%] | Overall Judgment |
|---|---|---|---|---|---|
| 1 | 5.0 | 2 | 0.2 | ○ | × |
| 2 | 5.0 | 2.8 | 0.8 | ○ | × |
| 3 | 5.0 | 2.9 | 10 | ○ | ○ |
| 4 | 5.0 | 3 | 11 | ○ | ○ |
| 5 | 5.0 | 4 | 11 | ○ | ○ |
| 6 | 5.0 | 6 | 12 | ○ | ○ |
| 7 | 5.0 | 8 | 12 | ○ | ○ |
| 8 | 5.0 | 9 | 12 | ○ | ○ |
| 9 | 5.0 | 10 | 13 | ○ | ○ |
| 10 | 5.0 | 11 | 13 | ○ | ○ |
| 11 | 5.0 | 12 | 13 | × | × |
| 12 | 5.0 | 13 | 13 | × | × |

Table 6 Experimental result of G and illuminance/illuminance stability in case of $F_2$ concentration $C_F$=10.0%

| | $C_F$ [%] | $G$ [mm] | Illuminance [mW/cm$^2$] | Illuminance Stability [%] | Overall Judgment |
|---|---|---|---|---|---|
| 1 | 10.0 | 2 | 0.2 | ○ | × |
| 2 | 10.0 | 2.8 | 0.8 | ○ | × |
| 3 | 10.0 | 3 | 10 | ○ | ○ |
| 4 | 10.0 | 4 | 11 | ○ | ○ |
| 5 | 10.0 | 5 | 11 | ○ | ○ |
| 6 | 10.0 | 6 | 12 | ○ | ○ |
| 7 | 10.0 | 7 | 12 | ○ | ○ |
| 8 | 10.0 | 8 | 12 | ○ | ○ |
| 9 | 10.0 | 9 | 13 | ○ | ○ |
| 10 | 10.0 | 10 | 13 | ○ | ○ |
| 11 | 10.0 | 11 | 13 | × | × |
| 12 | 10.0 | 12 | 13 | × | × |

FIG.9

FIG.11

| Rare gas | Halogen | Discharge wavelength [nm] |
|---|---|---|
| Ar | F | 193 |
| Kr | F | 248 |
| Xe | F | 351 |

ESCIMER LAMP HAVING DISCHARGE GAP CONTROLLED BY FLUORINE CONCENTRATION

CROSS-REFERENCES TO RELATED APPLICATION

This application claims priority from Japanese Patent Application Serial No. 2009-254483 filed Nov. 6, 2009, the contents of which are incorporated herein by reference in their entirety.

TECHNICAL FIELD

The present invention relates to an excimer lamp, and, especially, an excimer lamp in which rare gas and fluorine are enclosed in an arc tube made of translucent ceramics.

BACKGROUND

In an excimer lamp, an arc tube, which serves as dielectrics, is arbitrarily filled up with light emission gas and halogen, wherein excimer molecules are generated in the arc tube by dielectric barrier discharge, so that excimer light is emitted from the excimer molecules. Such a lamp is used as an ultraviolet ray light source for photochemical reactions. In such an excimer lamp, rare gas (argon, krypton, xenon, etc.) and fluorine are enclosed as an electric discharge gas depending on the wavelength of excimer light to be obtained.

FIG. 11 is a table showing the relation of combinations of rare gas and fluorine and radiation wavelength. Light having wavelength shown in the table is used for a surface alteration and sterilization. Specifically, an excimer lamp, in which argon-fluorine or krypton-fluorine is enclosed and emission of light whose wavelength is 193 nm or 248 nm can be obtained, is widely used for lithography, and a wide variety of fields, such as a characteristic test of a photo-sensitive film, circumference exposure, and a mask examination.

SUMMARY

The present invention relates to an excimer lamp that has a translucent ceramics arc tube that encloses a rare gas and a fluorine; and at least one of a set of external electrodes formed on an outer surface of the translucent ceramics arc tube where $2.5+0.5\log(C_F)\leqq G\leqq 14-4\log(C_F)$ is satisfied when $0.1\leqq C_F\leqq 10$. G (mm) is a discharge gap in the arc tube and $C_F$ (%) is a molar concentration of fluorine.

BRIEF DESCRIPTION OF THE DRAWINGS

Other features and advantages of the present excimer lamp will be apparent from the ensuing description, taken in conjunction with the accompanying drawings, in which:

FIG. 4 is a table 1 showing the relation of a discharging gap (G), and illuminance and illuminance stability, when $F_2$ concentration is $C_F$=0.1%;

FIG. 5 is a table 2 showing the relation of a discharging gap (G), and illuminance and illuminance stability, when $F_2$ concentration is $C_F$=0.5%;

FIG. 6 is a table 3 showing the relation of a discharging gap (G), and illuminance and illuminance stability, when $F_2$ concentration is $C_F$=1.0%;

FIG. 7 is a table 4 showing the relation of a discharging gap (G), and illuminance and illuminance stability, when $F_2$ concentration is $C_F$=2.0%;

FIG. 8 is a table 5 showing the relation of a discharging gap (G), and illuminance and illuminance stability, when $F_2$ concentration is $C_F$=5.0%;

FIG. 9 is a table 6 showing the relation of a discharging gap (G), and illuminance and illuminance stability, when $F_2$ concentration is $C_F$=10.0%;

FIG. 11 is a table showing the relation of combinations of rare gas and fluorine and radiation wavelength.

DESCRIPTION

A problem exists where an optical output emitted from an excimer lamp decreases. Rare gas and fluorine are needed for an excimer lamp's optical output when that excimer lamp uses fluorine, as discharge gas, and has a silica glass electric discharge container. When the fluorine is taken up into the silica glass, the fluorine amount in the electrical discharge space decreases. Thus, because the fluorine decreases the production amount of excimer molecules generated by the rare gas and the fluorine also decrease, and, in turn, the optical output emitted from the excimer lamp decreases.

The cause of fluorine being taken up into the silica glass maybe for the reasons considered below. That is, when the silica glass, which forms the electric discharge container receives irradiation of a lot of ultraviolet rays emitted from excimer molecules, a part of (═Si—O—Si═) binding of a surface is broken, which forms a defect, such as ═Si. ("." means an unpaired electron, and "=" means "combined with oxygen") that reacts with the fluorine in the electrical discharge space. Therefore, the amount of production of the excimer molecules generated by the fluorine and the rare gas decreases, thereby decreasing the optical output thereof.

To solve such a problem, Japanese Patent Application Publication No. 2009-59606 used an excimer lamp, in which an arc tube is formed using material other than silica glass, for example, sapphire, which is less reactive with fluorine. On the other hand, because high illuminance and illuminance stability are required for an excimer lamp it is difficult to find out the optimal lamp conditions, where they are simultaneously satisfied.

In view of the above-mentioned problems, it is an object of the present invention to offer an excimer lamp that can simultaneously fulfill the requirements of high illuminance and illuminance stability without decreasing an optical output emitted from the excimer lamp despite the passage of time.

To solve the above-mentioned problem, in the present excimer lamp, in which an arc tube made of translucent ceramics encloses a rare gas and fluorine, and external electrodes are provided on an outer face of the arc tube, a condition of $2.5+0.5\log(C_F)\leqq G\leqq 14-4\log(C_F)$ should be satisfied when $0.1\leqq C_F\leqq 10$, where is G (mm) is a discharge gap in the arc tube and $C_F$ (%) is a molar concentration of fluorine.

According to the present invention, it is possible to realize an excimer lamp with high illuminance and high illuminance stability by meeting these conditions.

Figure 1:
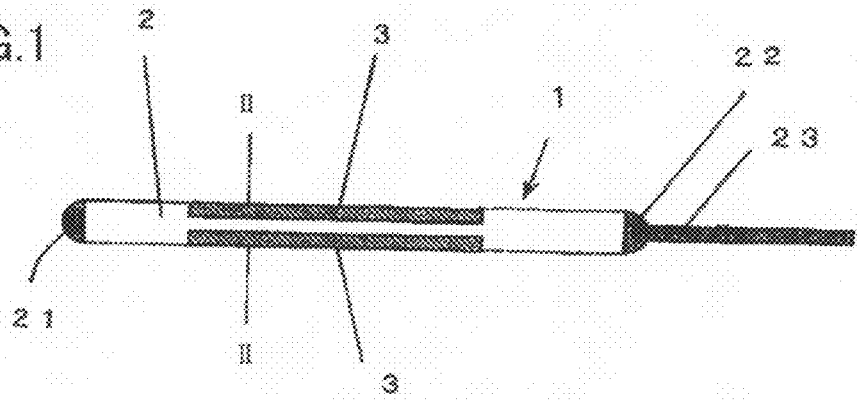
FIG. 1 is a schematic view of the structure of an excimer lamp 1 according to an embodiment of the present invention.
Figure 2:
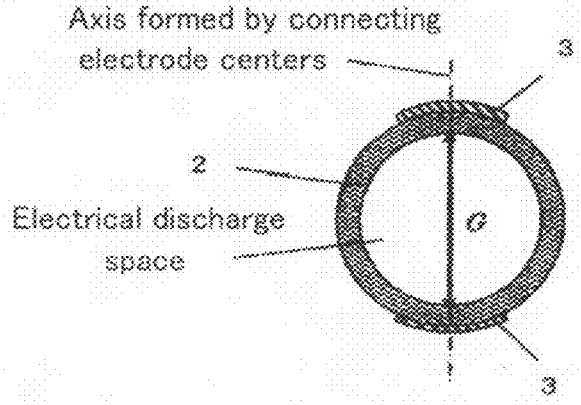
FIG. 2 is a cross sectional view of an excimer lamp 1 taken along a line II-II of FIG. 1.
Figure 3:
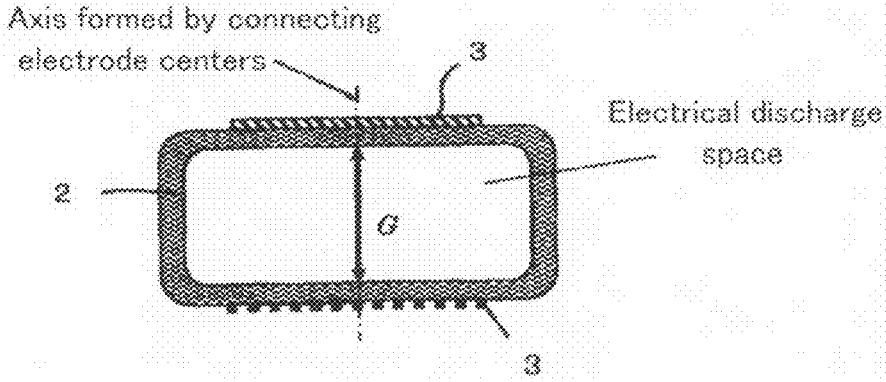
FIG. 3 is a cross sectional view of an excimer lamp 1, in which the shape of an arc tube differs from the excimer lamp 1 shown in FIGS. 1 and 2.

Description of an embodiment of the present invention will be given below, referring to FIGS. 1-10. FIG. 1 is a schematic view of the structure of an excimer lamp 1 according to an embodiment of the present invention, FIG. 2 is a cross sectional view of an excimer lamp 1 taken along a line II-II of FIG. 1, and FIG. 3 is a cross sectional view of an excimer lamp 1, in which the shape of an arc tube differs from the excimer lamp 1 shown in FIGS. 1 and 2. An arc tube 2 of the excimer lamp 1, shown in FIGS. 1 and 2, is made of sapphire (ϕ10×ϕ8×200 mm), which is a straight tube shaped translucent ceramics. Polycrystal alumina, YAG, $MgF_2$ and $CaF_2$, $LiF_2$, etc., as material other than the sapphire, may be used for the arc tube 2. Both ends of the longitudinal direction of the arc tube 2 are opened, and caps 21 and 22 are brazed at these ends, using silver-copper brazing as metal for sealing, for example, which consist of a nickel (Ni) or alloy whose main ingredient is nickel.

A gas pipe 23 made of nickel is provided in one of the caps 22, and after air in the arc tube 2 is discharged and the pressure is reduced through the gas pipe 23, rare gas and fluorine are enclosed. After enclosing these substances, an end portion of the gas pipe 23 is sealed by pressure welding, which forms a sealed structure of the arc tube 2.

When nickel or an alloy whose main ingredient is nickel is used for the caps 21 and 22, reactivity with fluorine is low, which allows the reduction speed of the halogen in the arc tube 2 to be controlled. Thus, even if a lamp is lighted for a long time, it is possible to reduce a drop of an optical output.

A pair of external electrodes 3 is arranged on an outer surface of the arc tube 2. As shown in FIGS. 1, 2, and 3, the electrodes 3 are provided to extend along an axis direction of the arc tube 2. These external electrodes 3 are formed by, for example, applying gold paste to the outer circumferential surface of the arc tube 2, and then drying it.

Electric discharge is generated between the pair of external electrodes 3 through the arc tube 2 by impressing voltage between the external electrodes 3 at the time of lamp lighting. When argon (Ar) and sulfur hexafluoride ($SF_6$) are enclosed in the arc tube 2, they are ionized so that argon ions and fluorine ions are formed, and excimer molecules that are made of argon-fluorine are formed. Thus, light with a wavelength of approximately 193 nm is emitted from the arc tube 2.

As shown in FIGS. 2 and 3, in these excimer lamps, a discharging gap G (mm) is an electrical discharge space distance along an axis formed by connecting the center of one of the external electrodes 3 to that the other external electrode 3. In the excimer lamp shown in FIG. 2, the discharging gap (G), which is an inner diameter of a bulb, is 8 mm.

These excimer lamps, whose discharging gap (G) and $F_2$ molar concentration ($C_F$) in enclosed gas were changed variously, were prepared. By electric discharge, which was formed in the discharge space by supplying electric power from high voltage/high frequency power supply for lighting (peak voltage was 3 kV, and lighting frequency was 50 kHz), illuminance of ArF excimer light with wavelength of 193 nm (illuminance at a distance of 5 mm from a lamp surface) and illuminance stability (illuminance stability at a distance of 5 mm from a lamp surface) were examined.

FIG. 4 is a table 1 showing the relation of a discharging gap (G), and illuminance and illuminance stability in case of $F_2$ concentration $C_F$=0.1% . FIG. 5 is a table 2 showing the relation of discharging gap (G), and illuminance and illuminance stability in case of $F_2$ concentration $C_F$=0.5% . FIG. 6 is a table 3 showing the relation of discharging gap (G), and illuminance and illuminance stability in case of $F_2$ concentration $C_F$=1.0%. FIG. 7 is a table 4 showing the relation of discharging gap (G), and illuminance and illuminance stability in case of $F_2$ concentration $C_F$=2.0%. FIG. 8 is a table 5 showing the relation of discharging gap (G), and illuminance and illuminance stability in case of $F_2$ concentration $C_F$=5.0%. FIG. 9 is a table 6 showing the relation of a discharging gap (G), and illuminance and illuminance stability in case of $F_2$ concentration $C_F$=10.0%. In addition, when the $F_2$ molar concentration ($C_F$) is higher than 10%, the lamp cannot be turned on, since the discharge start voltage is too high. Furthermore, when the $F_2$ molar concentration ($C_F$) is less than 0.1%, an optical output life is approximately 10% or less, so that it could not be actually used. Therefore, the applicable scope of the molar concentration ($C_F$) of the fluorine is 0.1 $C_F \leqq 10$. In addition, the illuminance stability is considered acceptable (○) when a fluctuation range of illuminance is within ±10% from an average of the illuminance for several minutes, for example, approximately for two minutes.

As shown in Table 1, there are big differences in illuminance depending on a value of the discharging gap (G), and the illuminance becomes rapidly high, when the discharging gap (G) is a certain size (2 mm) or larger. On the other hand, when the discharging gap (G) becomes larger than a certain size (18 mm), the illuminance stability becomes worse, and it becomes impossible to turn on the lamp. More specifically, although discharge plasma is uniformly distributed over the electrical discharge space when the discharging gap (G) is small (less than 2 mm), as the discharging gap (G) is larger (2 mm or more), a filament, which is formed by convergence of plasma, comes to be included therein. It is presumed that high intensity radiation comes out from the filament. When the discharging gap (G) is widened to some extent (18 mm), the above-mentioned filament moves around in the space, that is, the filament wobbles whereby the illuminance instability becomes worse.

Because of the above mentioned reasons, as shown in Tables 1-6, when the $F_2$ molar concentration ($C_F$) was changed (that is, 0.1%, 0.5%, 1.0%, 2.0%, 5.0%, and 10.0%) the range in which overall judgment was considered acceptable (symbol "○") was identified.

Figure 10:
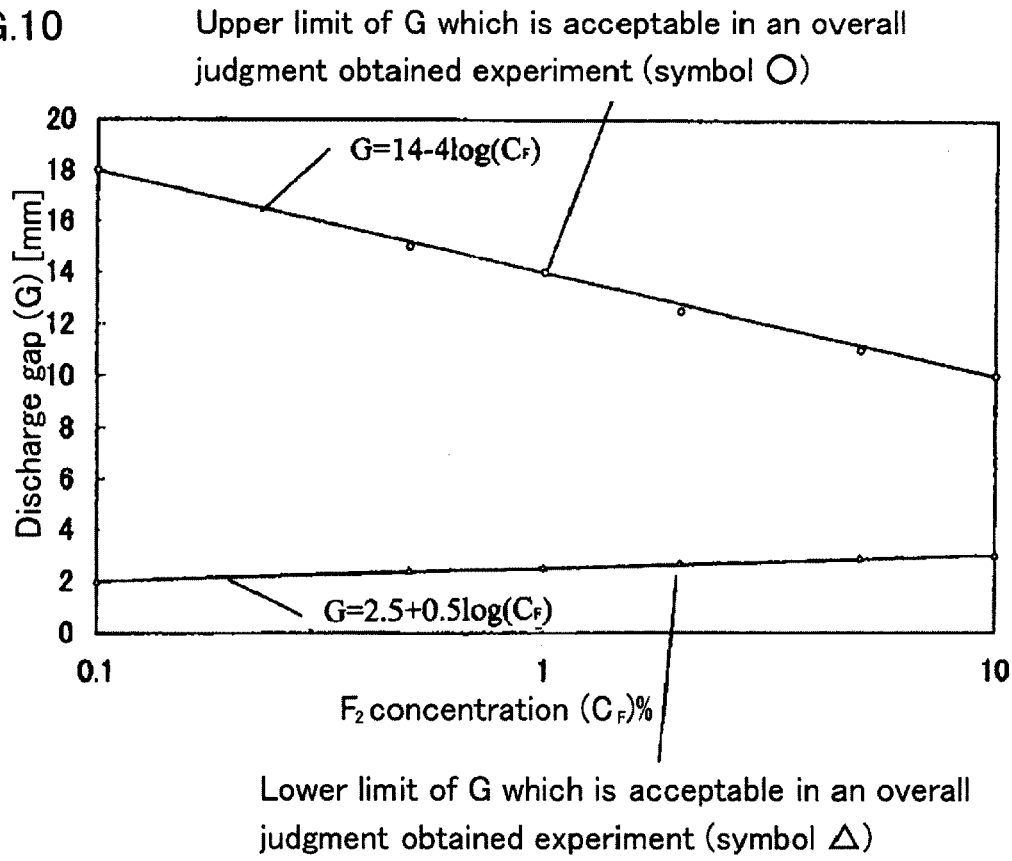
FIG. 10 is a diagram showing a applicable range of a discharging gap (G), which is obtained from overall judgments are considered as acceptable, in case of $0.1\%\leqq F_2$ molar concentration $(C_F)\leqq 10.0\%$.

FIG. 10 is a diagram showing the applicable scope of the a discharging gap (G), which is obtained by drawing lines of upper and lower limits of the range in which overall judgments are considered acceptable when the $F_2$ molar concentration ($C_F$) is changed from 0.1% to 10.0%. The scope of this discharging gap (G) is expressed by the following mathematical formula:

$$2.5+0.5 \log (C_F) \leqq G \leqq 14-4 \log(C_F)$$

In addition, the lowest of log in this formula is 10.

Although in the experimental results shown in Tables 1-6, argon is used for the rare gas, since the behavior of the filament depends on fluorine even when krypton or xenon is used as the rare gas, there is no change in the numerical value range.

The preceding description has been presented only to illustrate and describe exemplary embodiments of the present excimer lamp. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. An excimer lamp comprising:

a translucent ceramics arc tube that encloses a rare gas and a fluorine; and a set of external electrodes that are formed on an outer surface of the translucent ceramics arc tube, wherein $2.5+0.5\log(C_F) \leqq G \leqq 14-4\log(C_F)$ is satisfied when $0.1 \leqq C_F \leqq 10$, wherein G (mm) is a discharge gap in the arc tube and $C_F$ (%) is a molar concentration of the fluorine.

2. An excimer lamp according to claim 1, wherein the rare gas is one of argon, krypton and xenon.

3. An excimer lamp according to claim 1, wherein the discharge gap G is between 2 mm and 18 mm.

* * * * *